US008240887B2

(12) United States Patent
Daily et al.

(10) Patent No.: US 8,240,887 B2
(45) Date of Patent: Aug. 14, 2012

(54) LED LIGHT MODULE

(75) Inventors: Christopher George Daily, Harrisburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 70 days.

(21) Appl. No.: 12/870,436

(22) Filed: Aug. 27, 2010

(65) Prior Publication Data

US 2012/0051065 A1 Mar. 1, 2012

(51) Int. Cl.
*F21V 11/00* (2006.01)

(52) U.S. Cl. ..... 362/311.02; 362/236; 362/311.14; 362/364

(58) Field of Classification Search ..... 362/235, 362/236, 240, 219.01, 249.02, 362, 364, 362/311.02, 311.06, 311.13, 311.14, 29.01, 362/311.144; 439/220, 226, 602, 699.2
See application file for complete search history.

(56) References Cited

U.S. PATENT DOCUMENTS

| | | | | |
|---|---|---|---|---|
| 5,949,067 | A * | 9/1999 | Sano | 250/231.13 |
| 6,554,452 | B1 * | 4/2003 | Bourn et al. | 362/247 |
| 7,784,973 | B2 * | 8/2010 | Zhang et al. | 362/294 |
| 8,083,381 | B2 * | 12/2011 | Tsai | 362/311.02 |
| 2011/0194292 | A1 * | 8/2011 | Tsai | 362/311.02 |

* cited by examiner

*Primary Examiner* — John A Ward

(57) ABSTRACT

A light module includes a light engine having a printed circuit board and an array of light emitting diodes (LEDs) coupled to the printed circuit board. The printed circuit board has a power connector interface defining a separable interface for coupling with a power connector of the light module. A base ring holds the light engine and has side walls defining a cavity. The side walls have a securing feature. An optical component is received in the cavity and is positioned to receive light from the LEDs. The optical component has a predetermined lighting characteristic and emits the light generated by the LEDs in accordance with the predetermined lighting characteristic. A top cover is coupled to the base ring and has a securing feature engaging the securing feature of the base ring to couple the top cover to the base ring. A compression ring is positioned between the base ring and the optical component. The compression ring is compressed between the base ring and the optical component when the top cover is coupled to the base ring.

20 Claims, 8 Drawing Sheets

LED LIGHT MODULE

BACKGROUND OF THE INVENTION

The subject matter herein relates generally to solid state lighting systems and, more particularly, to a light emitting diode (LED) light module.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

Solid-state lighting systems typically include different components that are assembled together to complete the final system. For example, the system typically consists of a light engine, an optical component and a power supply. It is not uncommon for a customer assembling a lighting system to have to go to many different suppliers for, each of the individual components, and then assemble the different components, from different manufacturers together. Purchasing the various components from different sources proves to make integration into a functioning system difficult. This non-integrated approach does not allow the ability to effectively package the final lighting system in a lighting fixture efficiently.

The light engine of the solid state light system generally includes an LED soldered to a circuit board. The circuit board is configured to be mounted in a lighting fixture. The lighting fixture includes the power supply to provide power to the LED. Typically, the circuit board is wired to the lighting fixture using wires that are soldered to the circuit board and the fixture. Generally, wiring the circuit board to the light fixture power source requires several wires and connections. Each wire must be individually joined between the circuit board and the lighting fixture.

Wiring the circuit board with multiple wires generally requires a significant amount of time and space. In fixtures where space is limited, the wires may require additional time to connect. Additionally, having multiple wires to connect requires multiple terminations, increasing the time required to connect the LEDs. Moreover, using multiple wires increases the possibility of mis-wiring the lighting system. In particular, LED light fixtures are frequently installed by unskilled labor, thereby increasing the possibility of mis-wiring. Mis-wiring the lighting system may result in substantial damage to the LED. Also, in a system where wires are soldered between the circuit board and the fixture, the wires and circuit boards become difficult to replace.

Furthermore, the light engines typically generate a lot of heat and it is desirable to use a heat sink to dissipate heat from the system. Heretofore, LED manufacturers have had problems designing a thermal interface that efficiently dissipates heat from the light engine.

A need remains for lighting systems that can be powered efficiently. A need remains for lighting systems with LEDs that have adequate thermal dissipation. A need remains for lighting systems with LEDs that are assembled in an efficient and cost-effective manner. A need remains for a lighting system that may be efficiently configured for an end use application.

BRIEF DESCRIPTION OF THE INVENTION

In one embodiment, a light module is provided that includes a light engine having a printed circuit board and an array of light emitting diodes (LEDs) coupled to the printed circuit board. A base ring holds the light engine. The base ring has side walls defining a cavity that have a securing feature. An optical component is received in the cavity and is positioned to receive light from the LEDs. The optical component has a predetermined lighting characteristic and is configured to emit the light generated by the LEDs in accordance with the predetermined lighting characteristic. A top cover is coupled to the base ring. The top cover has a securing feature engaging the securing feature of the base ring to couple the top cover to the base ring. A, compression ring is positioned between the top cover and the optical component. The compression ring is compressed between the top cover and the optical component when the top cover is coupled to the base ring.

In another embodiment, a light module is provided including a light engine having a printed circuit board and an array of light emitting diodes (LEDs) coupled to the printed circuit board. The printed circuit board has a power connector interface defining a separable interface for coupling with a power connector of the light module. A base ring holds the light engine and has side walls defining a cavity. The side walls have a securing feature. An optical component is received in the cavity and is positioned to receive light from the LEDs. The optical component has a predetermined lighting characteristic and emits the light generated by the LEDs in accordance with the predetermined lighting characteristic. A top cover is coupled to the base ring and has a securing feature engaging the securing feature of the base ring to couple the top cover to the base ring. A compression ring is positioned between the top cover and the optical component. The compression ring is compressed between the top cover and the optical component when the top cover is coupled to the base ring.

In a further embodiment, a light module is provided including a base ring having side walls defining a cavity and a securing feature. A set of light engines are provided including at least two different types of printed circuit boards (PCBs) that have different arrays of light emitting diodes (LEDs) coupled thereto. A select one of the PCBs is positioned within the cavity. A set of optical components is provided including at least two different types of optical components. The different types of optical components differ from one another by having different lighting patterns. A select one of the optical components are received in the cavity adjacent to the selected PCB and receive light from the LEDs. The selected optical component is configured to emit the light generated by the LEDs in accordance with a predetermined lighting characteristic. A top cover is coupled to the base ring and has a securing feature engaging the securing feature of the base ring to couple the top cover to the base ring. A compression ring is positioned between the top cover and the optical component. The compression ring is compressed between the top cover and the optical component when the top cover is coupled to the base ring.

DETAILED DESCRIPTION OF THE INVENTION

Figure 1:
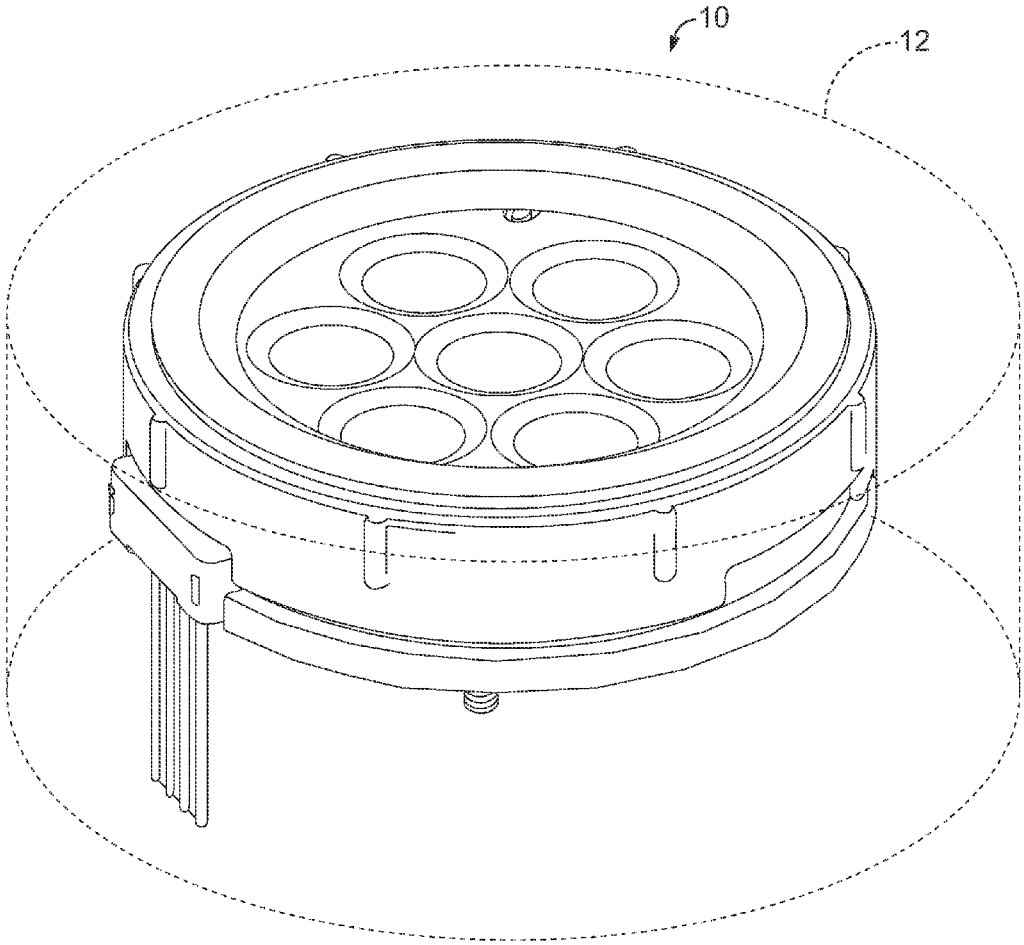
FIG. 1 is a top perspective view of a light module formed in accordance with an exemplary embodiment received in a fixture.

FIG. 1 illustrates a light module 10 for use in a device 12 (shown in phantom). The light module 10 generates light for the device 12. The device 12 may be any type of lighting device, such as a light fixture. In exemplary embodiment, the device 12 may be a can light fixture, however, the light module 10 may be used with other types of lighting devices in alternative embodiments.

Figure 2:
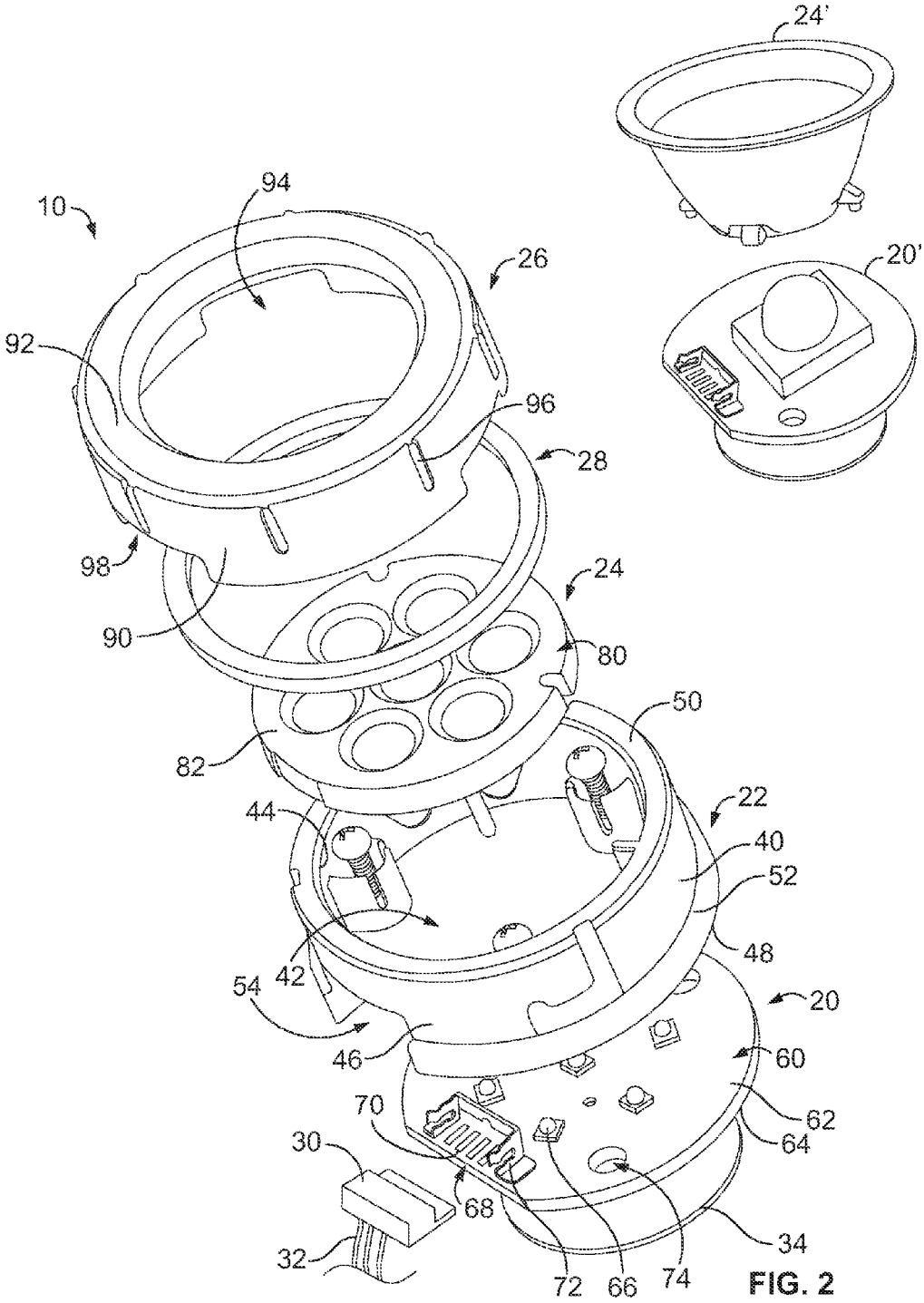
FIG. 2 is an exploded view of the light module shown in FIG. 1.

FIG. 2 is an exploded view of the light module 10. The light module 10 includes a light engine 20, a base ring 22 holding the light engine 20, an optical component 24 received in the base ring 22, and a top cover 26 coupled to the base ring 22 to hold the optical component 24 within the base ring 22. A compression ring 28 is configured to be held between the top cover 26 and the base ring 22 and/or the optical component 24. A thermal pad 34 is optionally coupled to the light engine 20 to dissipate heat from the light engine 20.

A power connector 30 is configured to be coupled to the light engine 20 to provide power to the light engine 20. The power connector 30 is terminated to an end of a power cable 32. In an exemplary embodiment, the power connector 30 is configured to be couple to the light engine 20 at a separable interface. For example, the power connector 30 may be plugged into the light module 10 and unplugged from the light module 10.

The base ring 22 includes a side wall 40 defining a cavity 42. In the illustrated embodiment, the side wall 40 has a cylindrical shape defined by an inner surface 44 and an outer surface 46. The side wall 40 extends between a bottom edge 48 and a top edge 50 opposite the bottom edge 48. In exemplary embodiment, the side wall 40 has a rim 52 proximate to the bottom edge 48. The rim 52 extends outward from the outer surface 46. The side wall 40 includes an opening 54 therethrough that is configured to receive the power connector 30. The opening 54 provides access to the light engine 20 such that the power connector 30 may be coupled to the light engine 20.

The light engine 20 includes a printed circuit board (PCB) 60 having a first surface 62 and a second surface 64. The PCB 60 includes a plurality of openings 74 extending therethrough between the first and second surfaces 62, 64. The thermal pad 34 is coupled to the second surface 64 to dissipate heat from the PCB 60. Optionally, the thermal pad 34 may be coupled to the second surface 64 using a thermally conductive epoxy, a thermal grease or a thermally conductive adhesive. Other securing means may be used to secure the thermal pad 34 to the second surface 64 in alternative embodiments.

An array of light emitting diodes (LEDs) 66 is coupled to the first surface 62 of the PCB 60. The LEDs 66 emit light therefrom. Any number of LEDs 66, including a single LED 66, may be provided within the light engine 20. Each of the LEDs 66 may be identical to one another. Alternatively, different types of LEDs 66 having different lighting characteristics, such as color, intensity and the like, may be provided. The LEDs 66 may be powered in accordance with a certain lighting scheme. Optionally, only a subset of the LEDs 66 may be powered at a given time in some situations. The LEDs 66 are arranged in a predetermined pattern on the PCB 60. The LEDs 66 are spaced apart from one another in accordance with such pattern. The LEDs 66 are electrically connected to circuitry within the PCB 60 and power is fed to the LEDs 66 by the PCB 60. The heat generated by the LEDs 66 is dissipated through the PCB 60, such as into the heat sink.

The PCB 60 has a power connector interface 68. In an exemplary embodiment, the power connector interface 68 includes one or more pads 70 provided on the first surface 62. A clip 72 is coupled to the first surface 62 at the power connector interface 68. The power connector 30 is coupled to the power connector interface 68 to supply power to the PCB 60. The power connector 30 includes one or more power contacts (not shown) that are electrically connected to the power cable 32 to supply power to the PCB 60. For example, the power contacts may be terminated to corresponding pads 70 at the power connector interface 68. The clip 72 is used to secure the power connector 30 to the light module 10. For example, the clip 72 may include latches or other securing features that engage the power connector 30 to couple the power connector 30 to the light module 10. In an exemplary embodiment, the power connector interface 68 constitutes a separable interface. The power connector 30 may be mated and unmated to the power connecter interface 68. A nonpermanent connection is made between the power connector 30 and the PCB 60 at the separable power connector interface 68. For example, a solderless connection is provided between the power connector 30 and the power connector interface 68. Other types of securing features other than the clip 72 may be used to couple the power connector 30 to the light module 10. For example, the base ring 22 may include features to secure the power connector 30 within the light module 10.

In an exemplary embodiment, the light module 10 may include a set of light engines 20 including at least two different types of light engines 20. The different types of light engines 20 differ from one another by having different lighting characteristics. For example, the different types of light engines 20 may have a different number of LEDs 66 or a different arrangement of LEDs 66 on the surface of the PCB 60. The different types of light engines 20 may have different types of LEDs 66, such as LEDs 66 that generate different colors or intensities of light. FIG. 2 illustrates a second light engine 20' that may be used with the light module in place of the light engine 20. For example, during assembly, the manufacturer may select either the light engine 20 or the light engine 20' (or another light engine) to be received in the cavity 42. Depending on which light engine 20 or 20' is selected, the light module 10 may have different lighting characteristics. The light module 10 is customizable by providing different types of light engines 20, 20' for use therewith. The light module 10 is configurable by selecting from the set of light engines 20 to achieve a desired light distribution. As will be described in further detail below, the light module 10 is easily configurable either pre or post installation by replacing the light engine 20 with a different light engine 20' selected from the set of light engines usable with the light module 10. As such, should the desired lighting characteristics of the light module 10 change or become different, the light engine 20 may be easily replaced.

The optical component 24 includes a lens 80 having an outer surface 82. The optical component 24 is configured to be received in the cavity 42 such that the optical component 24 receives light emitted for the LEDs 66. The optical component 24 has a predetermined light characteristic and is configured to emit the light generated by the LEDs 66 through the lens 80 in accordance with the predetermined characteristic. The lighting characteristic may have an effect on the light output of the light module 10. For example, the lighting characteristic may correspond to a particular light beam output angle. The optical component 24 may be configured to provide a wide angle of illumination. Alternatively, the optical component 24 may be configured to provide a narrow or focused illumination angle. The particular lighting characteristic may be dependant on the number of LEDs 66 within the array and/or the type of LEDs 66 within the array.

In an exemplary embodiment, the light module 10 may include a set of optical components 24 including at least two different types of optical components 24. The different types of optical components 24 differ from one another by having different lighting characteristics. For example, the different types of optical components 24 may have different lighting patterns and/or, different lighting characteristics. FIG. 2 illustrates a second optical component 24' that may be used with the light module in place of the optical component 24. The optical component 24' represents a reflector, however other types of optical components may be utilized in alternative embodiments. For example, during assembly, the manufacturer may select either the optical component 24 or the optical component 24' (or another optical component) to be received in the cavity 42. Depending on which optical component 24 or 24' is selected, the light module 10 may have different lighting characteristics. The light module 10 is customizable by providing different types of optical components 24, 24' for use therewith. The light module 10 is configurable by selecting from the set of optical components 24 to achieve a desired light distribution. As will be described in further detail below, the light module 10 is easily configurable either pre or post installation by replacing the optical component 24 with a different optical component selected from the set of optical components usable with the light module 10. As such, should the desired lighting characteristics of the light module 10 change or become different, the optical component 24 may be easily replaced with a different optical component 24' without disrupting the light engine 20.

The compression ring 28 is configured to be coupled to the base ring 22 and/or the optical component 24 after the optical component 24 is loaded into the cavity 42. For example, the compression ring 28 may be placed over the outer surface 82 and/or the top edge 50 prior to coupling the top cover 26 the base ring 22. The compression ring 28 is made from a compressible material, such as foam material, a silicone rubber material, or another type of compressible material. In an alternative embodiment, the compression ring 28 may be manufactured from a metal material formed as a spring, such as a wave spring washer, that may be placed between the top cover 26 and the base ring 22 and/or the optical component 24. The compression ring 28 is ring shaped having an open interior. The open interior is aligned with the lens 80 such that the light may be emitted from the lens 80 through the compression ring 28. The compression ring 28 takes up tolerances between the optical component 24 and the top cover 26 when the top cover 26 is coupled to the base ring 22. The compression ring 28 provides compliancy for connecting the securing features of the base ring 22 with the securing features of the top cover 26 during assembly.

The top cover 26 includes a side wall 90 and a top wall 92. The top wall 92 has an opening 94 therethrough. The opening 94 is aligned above the lens 80 and allows light emitted by the lens 80 to be emitted from the light module 10. The top cover 26 is configured to be coupled to the base ring 22 during assembly of the light module 10. In an exemplary embodiment, the top cover 26 is rotatably coupled to the base ring 22, however the top cover may be coupled to the base ring 22 in a different manner using different securing means in alternative embodiments. During assembly, the top cover 26 is loaded onto the base ring 22 and rotated to a locked position. The top cover 26 holds the optical component 24 in the cavity 42. The compression ring 28 is received between the top cover 26 and optical component 24 to take up any tolerance between the top cover 26 and the optical component 24. Alternatively, the compression ring 28 may be positioned between the top cover 26 and the base ring 22 and a lip of the top cover 26 may engage the optical component 24 to hold the optical component 24 in the cavity 42. In an exemplary embodiment, the top cover 26 includes finger grips 96 on the outer surface of the side wall 90 to provide gripping features for gripping the top cover 26 during assembly with the base ring 22. In an exemplary embodiment, the top cover 26 includes one or more openings 98 at a bottom of the side wall 90. The openings 98 accommodate a portion of the power connector 30 when the power connector 30 is coupled to the light module 10.

Figure 3:
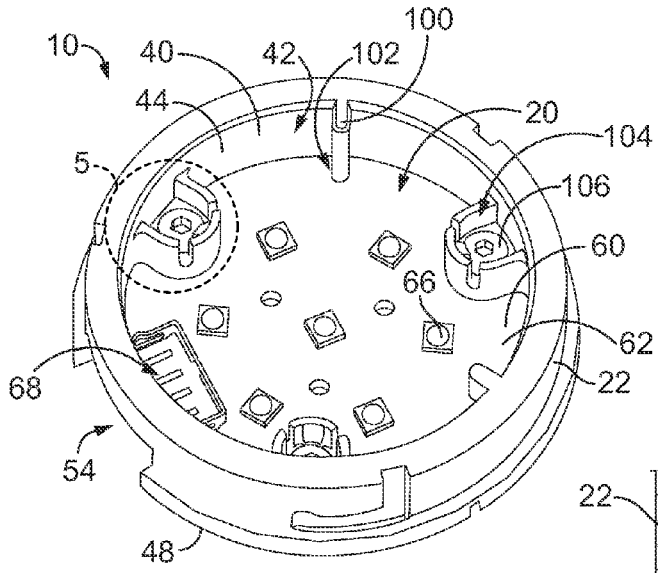
FIG. 3 is a top perspective view of a portion of the light module during assembly.
Figure 4:
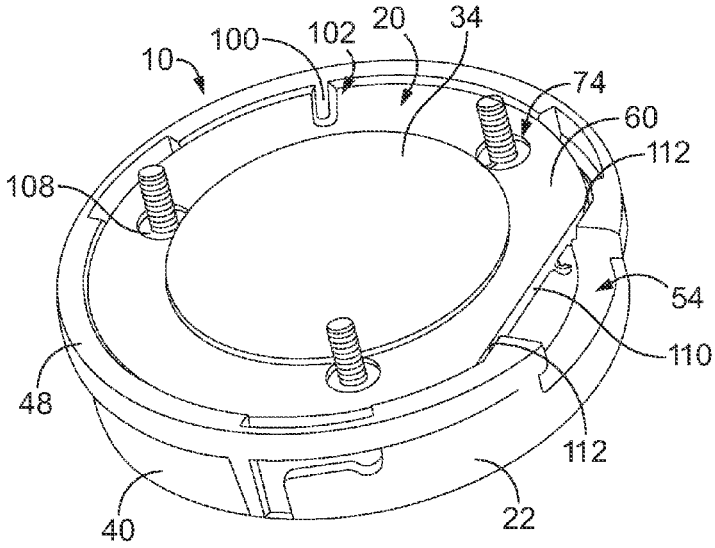
FIG. 4 is a bottom perspective view of the light module.

FIG. 3 a top perspective view of the base ring 22 with the light engine 20 coupled thereto. FIG. 4 is bottom perspective view of the base ring 22 with light engine 20 coupled thereto. In an exemplary embodiment, the base ring 22 includes one or more keying features 100 extending into the cavity for orienting the light engine 20 with respect to the base ring 22. The PCB 60 includes one or more keying features 102 that interact with the keying feature 100 to orient the light engine 20 with respect to the base ring 22. In the illustrated embodiment, the keying feature 100 constitutes tabs extending from the inner surface 44 of the side wall 40 into the cavity 42. The keying features 102 constitute cut outs in the PCB 60 that have a similar size and shape to the tabs.

In an exemplary embodiment, the light engine 20 is coupled to the base ring 22 by loading the PCB 60 through the bottom edge 48 of the base ring 22. The thermal pad 34 is coupled to the PCB 60. The first surface 62 faces upward such that the LEDs 66 are exposed within the cavity 42. The PCB 60 is loaded into the cavity 42 until the PCB 60 bottoms out against fastener mounts 104 of the base ring 22. The fastener mounts 104 hold fasteners 106 therein. The fasteners 106 are used to secure the light module 10 to another structure, such as the device 12 (shown in FIG. 1) or a heat sink of the device 12. The fastener mounts 104 extend inward from the inner surface 44 of the side wall 40 into the cavity 42. The fastener mounts 104 receive the fasteners 106 through the top of the fastener mounts 104. The fasteners 106 extend through the lugs 108 and the openings 74 in the PCB such that the fasteners 106 extend below the light module 10.

The fastener mounts 104 include lugs 108 extending from the bottom of the fastener mounts 104. The lugs 108 are received in the openings 74 of the PCB 60 when the PCB 60 is loaded into the base ring 22. The lugs 108 engage the PCB 60 in an interference fit to hold the PCB 60 within the base ring 22. Optionally, the lugs 108 may include crush ribs or other features to engage and hold the PCB 60. Other types of fastening means may be used to hold the PCB 60 within base ring 22 an alternative embodiment.

In an exemplary embodiment, the PCB 60 has a generally circular outer perimeter and includes a flat side 110 along a portion thereof. In an exemplary embodiment, the flat side 110 is provided at the power connector interface 68. The flat side 110 provides a keying feature for orienting the PCB 60 within the base ring 22. The flat side 110 provides an edge for receiving the power connector 30 (shown in FIG. 1) when the power connector 30 is coupled to the light engine 20. In an exemplary embodiment, the base ring 22 includes shoulders 112 extending along the flat side 110. The shoulders 112 provide a surface for the flat side 110 to rest against. The shoulders 112 define a keying feature of the base ring 22 to orient the PCB 60 within the base ring 22. The shoulders 112 are provided at the opening 54 and are provide on either side of the opening 54.

While the light module 10 is illustrated and described as being a circular light module, it is realized that other shapes are possible in alternative embodiments. For example, the base ring 22 and top cover 26 may have a non-circular shape, such as a rectangular shape. While the base is described as being a ring, the shape of the base may define a non-circular ring surrounding the PCB 60. The use of the term base ring is not intended to be limited to circular geometries. The shape of the PCB 60 and optical component 24 may correspond with the shape of the base ring 22 and/or top cover 26.

Figure 5:
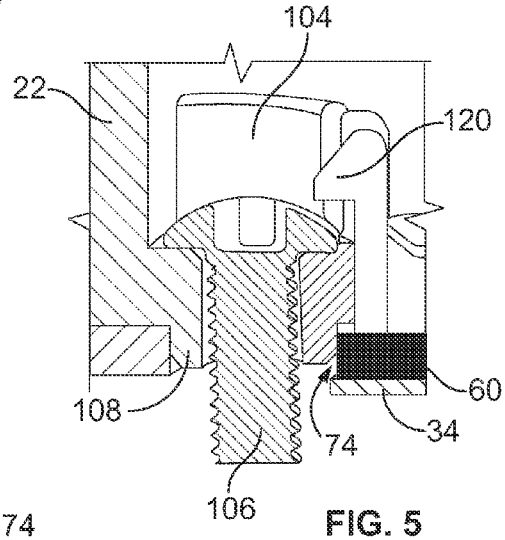
FIG. 5 is a sectional view of a portion of the light module.

FIG. 5 is a sectional view of a portion of the light module 10 around the fastener mount 104 and fastener 106. FIG. 5 illustrates the fastener 106 held within the fastener mount 104. In an exemplary embodiment, the fastener mount 104 includes a latch 120 along one of the walls of the fastener mount 104. The latch 120 is used to hold the fastener 106 within the fastener mount 104. For example, the latch 120 is positioned over the top of the fastener 106 to prevent removal of the fastener 106 from the fastener mount 104. The latch 120 is deflectable to allow the fastener 106 to be loaded into the fastener mount 104. Once the fastener 106 is positioned within the fastener mount 104, the latch 120 covers a portion of the fastener 106 to block removal of the fastener 106 from the fastener mount 104. The latch 120 may be manually deflected outward to remove the fastener 106 from the fastener mount 104.

When the PCB 60 is loaded into the base ring 22, the lug 108 is received in the opening 74. The outer surface of the lug 108 presses against the PCB 60 to hold the PCB 60 in position with respect to the base ring 22. Alternative securing means may be provided to hold the PCB 60 in the base ring 22. Optionally, rather than securing the PCB 60 in the base ring 22, the PCB 60 may be held on the heat sink, such as using locating features, and then the base ring 22 is coupled to the heat sink over the PCB 60. The base ring 22 may compress and hold the PCB 60 against the heat sink to ensure good thermal transfer therebetween. The thermal pad 34 (shown in FIG. 2) may be positioned between the PCB 60 and the heat sink to increase the thermal transfer therebetween. Other types of thermal materials may be used therebetween, such as a thermal interface material, a thermal epoxy, thermal grease, a thermal film or foil, and the like.

Figure 6:
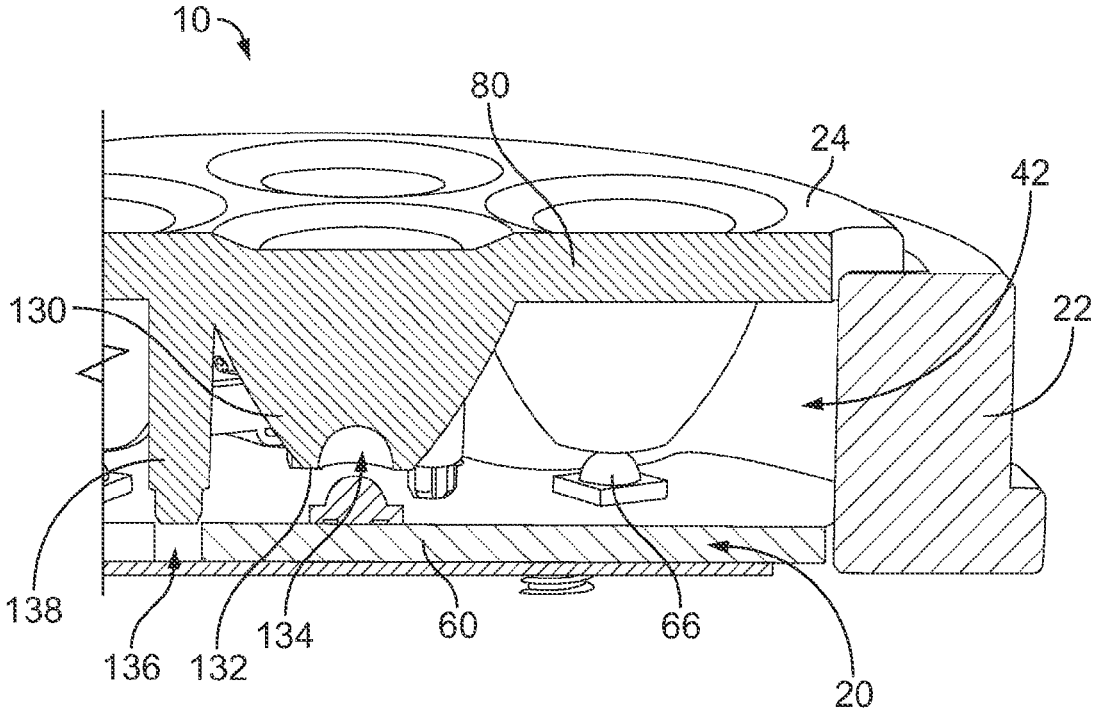
FIG. 6 is a sectional view of the light module illustrating an optical component being loaded into a base ring of the light module.

FIG. 6 is a sectional view of a portion of the light module 10 illustrating the optical component 24 being loaded into the cavity 42 of the base ring 22. The optical component 24 includes a plurality of cones 130 extending downward from the lens 80. Optionally, the cones 130 and the lens 80 may be integrally formed with each another such as during a molding process. Each cone 130 converges to a base 132 at the bottom of the cone 130. The base 132 is smaller than the portion of the cone 130 proximate to the lens 80. A recess 134 is provided in the base 132 that extends into the cone 130.

The optical component 24 is loaded into the base ring 22 such that the cones 130 are aligned with, and positioned adjacent to, corresponding LEDs 66 of the light engine 20. In an exemplary embodiment, when the optical component 24 is coupled to the base ring 22 the LED 66 is partially received in the recess 134. The cones 130 receive light emitted from the LEDs 66 and direct the light through the lens 80. The number of cones 130 corresponds with the number of LEDs 66. The positioning of the cones 130 corresponds with the positioning of the LEDs 66 on the PCB 60. In an exemplary embodiment, the optical component 24 is loaded into the base ring 22 until the base 132 is positioned adjacent to a corresponding LED 66.

The PCB 60 includes a plurality of holes 136 extending therethrough. The optical component 24 includes a plurality of posts 138 extending from the bottom of the lens 80. The posts 138 are aligned with the holes 136 in the PCB 60. When the optical component 24 is loaded into the base ring 22, ends of the post 138 are received in the holes 136. The holes 136 and post 138 operate to align the optical component 24 with respect to the PCB 60 such that the cones 130 may be aligned with the corresponding LEDs 66. In an exemplary embodiment, at least a portion of the lens 80 is received in the cavity 42 prior to the posts 138 being received in the holes 136. As such, the optical component 24 may be substantially aligned with the PCB 60 prior to the posts 138 being loaded into the holes 136. Having the optical component 24 at least partially loaded into the cavity 42 prior to the post 138 being loaded into the holes 136 locates and orients the optical component 24 with respect to the PCB 60 such that the post 138 are substantially aligned with holes 136. As the lens 80 is further loaded into the cavity 42, the posts 138 are loaded into the holes 136. In an exemplary embodiment, the cones 130 are elevated above the LEDs 66 when the posts 138 are outside of the holes 136. As such, the optical component 24 may be moved slightly within the cavity 42 to align the optical component 24 with respect to the PCB 60 with out damaging the LEDs 66.

Figure 7:
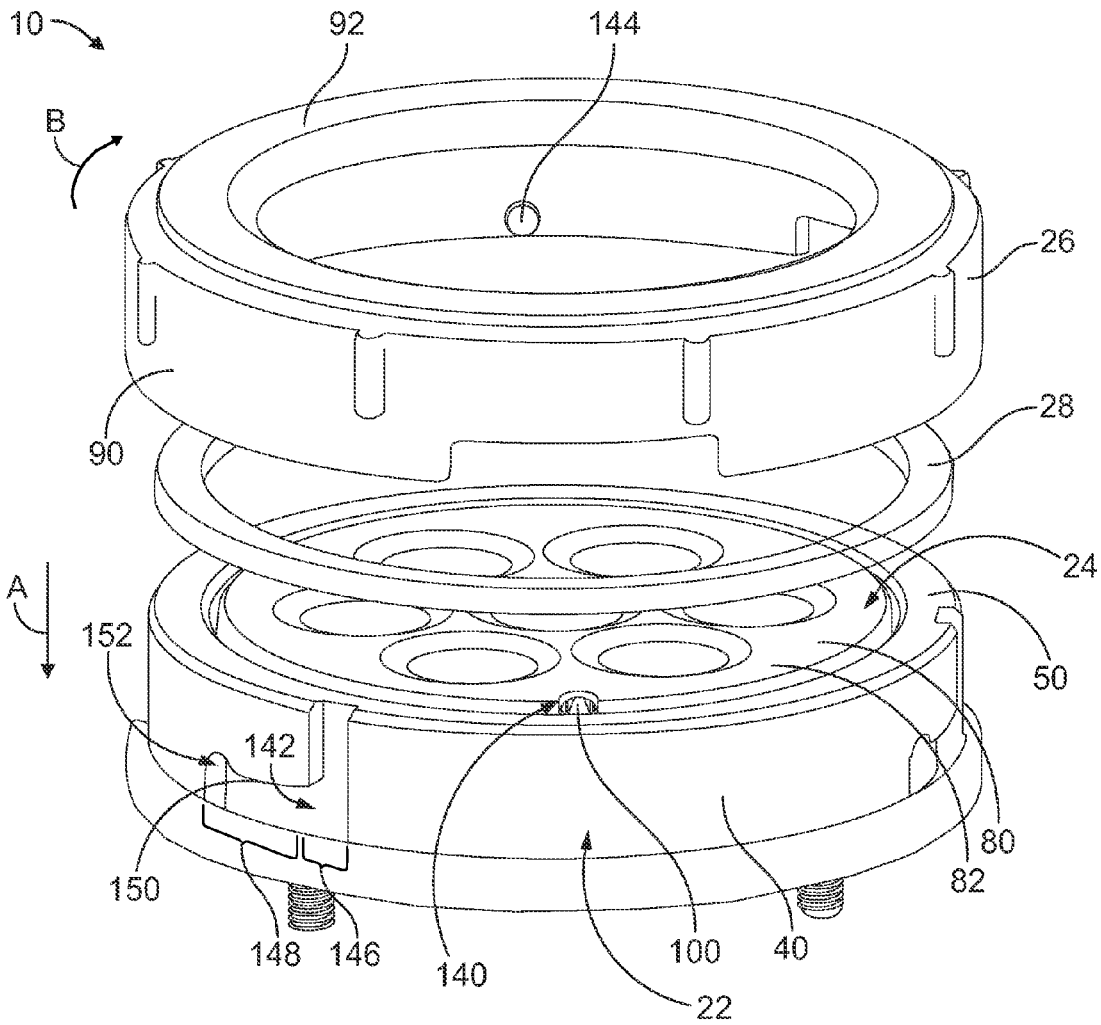
FIG. 7 is a sectional view of the light module in an assembled state.

FIG. 7 is a top perspective, partially exploded view of the light module 10 showing the optical component 24 loaded into the base ring 22. FIG. 7 illustrates the top cover 26 and compression ring 28 poised for mounting onto the base ring 22. In an exemplary embodiment, the optical component 24 includes a keying feature 140 that interacts with the keying feature 100 of the base ring 22. In the illustrated embodiment, the keying feature 140 constitutes a notch formed in the lens 80. The keying features 140, 100 orient the optical component 24 with respect to the base ring 22. Orienting the optical component 24 with respect to the base ring 22 also properly orients the optical component 24 with respect to the light engine 20 (shown in FIG. 2). In an exemplary embodiment, when the optical component 24 is loaded into the base ring 22 the lens 80 is substantially flush with the top edge 50 of the base ring 22.

The compression ring 28 is aligned above the top edge 50 of the base ring 22 and the outer surface 82 of the optical component 24. During assembly the compression ring 28 is seated on the top edge 50 and the outer surface 82 of the optical component 24. The compression ring 28 takes up any tolerance between the top cover 26 and the base ring 22 and/or optical component 24 when the top cover 26 is coupled to the base ring 22.

In an exemplary embodiment, the base ring 22 and the top cover 26 include securing features 142, 144, respectively. The securing features 142, 144 engage one another when the top cover 26 is coupled to the base ring 22. The engagement between the securing features 142, 144 secures the top cover 26 to the base ring 22. In an exemplary embodiment, the securing features 142, 144 allow mating and unmating of the top cover 26 to the base ring 22. As such, the top cover 26 may be removed from the base ring to access the other components, such as the optical component 24. As such, the optical component 24 maybe removed and replaced with a different type of optical component 24. In the illustrated embodiment, the securing feature 142 constitutes a recessed track formed in the side wall 40. The securing feature 144 constitutes a protrusion extending inward from the side wall 90 that is configured to be received in the recessed track to secure the top cover 26 to the base ring 22. Alternatively, the securing feature 142 may constitute a protrusion extending out from the side wall 40 and the securing feature 144 may constitute a recessed track in the inner surface of the side wall 90. Other types of securing features 142, 144 may be used in alternative embodiments. For example, the securing features 142, 144 may constitute threads on the side walls 40, 90 that allow threaded coupling between the top cover 26 and the base ring 22. Other examples of securing features 142, 144 include latches, pins, fasteners, and the like that are used to secure the top cover 26 with respect to the base ring 22.

In the illustrated embodiment, the securing features 142, 144 define a bayonet-type connection. The securing feature 142 constitutes a recessed track and may be referred to hereafter as a recessed track 142. The recessed track 142 includes a loading zone 146 and a mating zone 148. In the loading zone 146, the recessed track 142 extends generally vertically. In the mating zone 148, the recessed track 142 extends generally horizontally. During assembly, the securing feature 144 (represented by the protrusion in the illustrated embodiment) is initially loaded into the loading zone 146 in a first direction, represented by arrow A, and then the securing feature 144 is moved in a mating direction, represented by arrow B. The top cover 26 may be rotated or twisted in the mating direction.

In an exemplary embodiment, the securing feature 142 includes a cam surface 150 and a locking notch 152 at an end of the cam surface 150. The cam surface 150 is angled such that as the top cover 26 is rotated in the mating direction, the securing feature 144 rides along the cam surface 150. As the securing feature 144 rides along the cam surface 150, the top cover 26 is drawn downward onto the base ring 22. For example, the top wall 92 is drawn towards the top edge 50 of the side wall 40 when the securing feature 144 is rotated along the cam surface 150. As the top cover 26 is drawn downward, the compression ring 28 is compressed against the optical component 24. The top cover 26 and the compression ring 28 hold the optical component 24 against the light engine 20. The pressure on the optical component 24 is also transferred into the PCB 60, which forces the PCB 60 downward against the heat sink. The pressure from the compression ring 28 is therefore used to increase the thermal transfer between the PCB 60 and the heat sink.

During assembly, the top cover 26 is rotated in the mating direction until the securing feature 144 is received in the locking notch 152. The locking notch 152 is notched upward from the cam surface 150 to provide a space that receives the securing feature 144. When the securing feature 144 is received in the locking notch 152 rotation of the top cover 26 in an unmating direction, generally opposite to the mating direction, is restricted.

Figure 8:
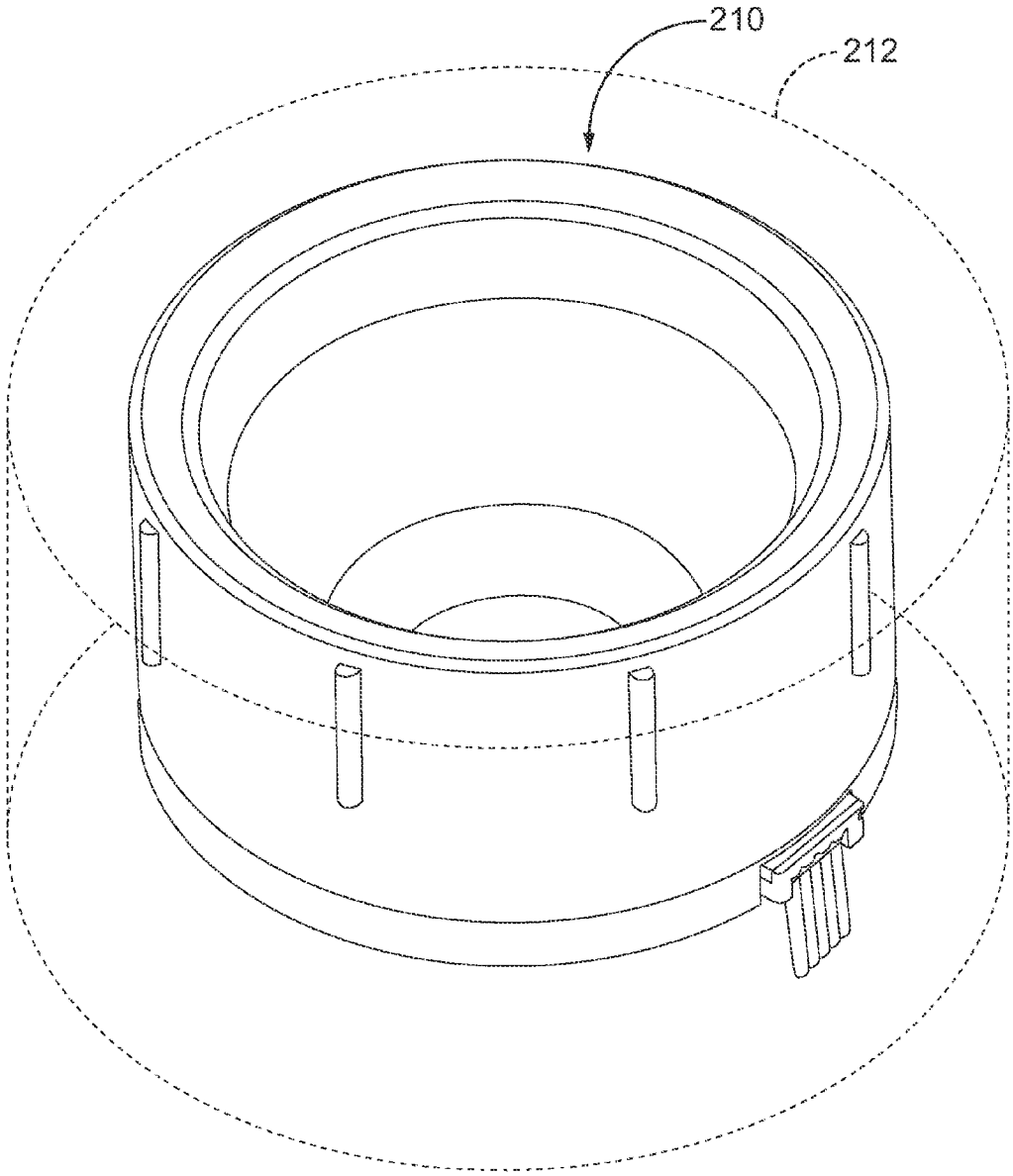
FIG. 8 illustrates an alternative light module formed in accordance with an exemplary embodiment for use in a device.

FIG. 8 illustrates a light module 210 for use in a device 212 (shown in phantom). The light module 210 generates light for the device 212. The device 212 may be any type of lighting device, such as a light fixture. In exemplary embodiment, the device 212 may be a can light fixture, however, the light module 210 may be used with other types of lighting devices in alternative embodiments.

Figure 9:
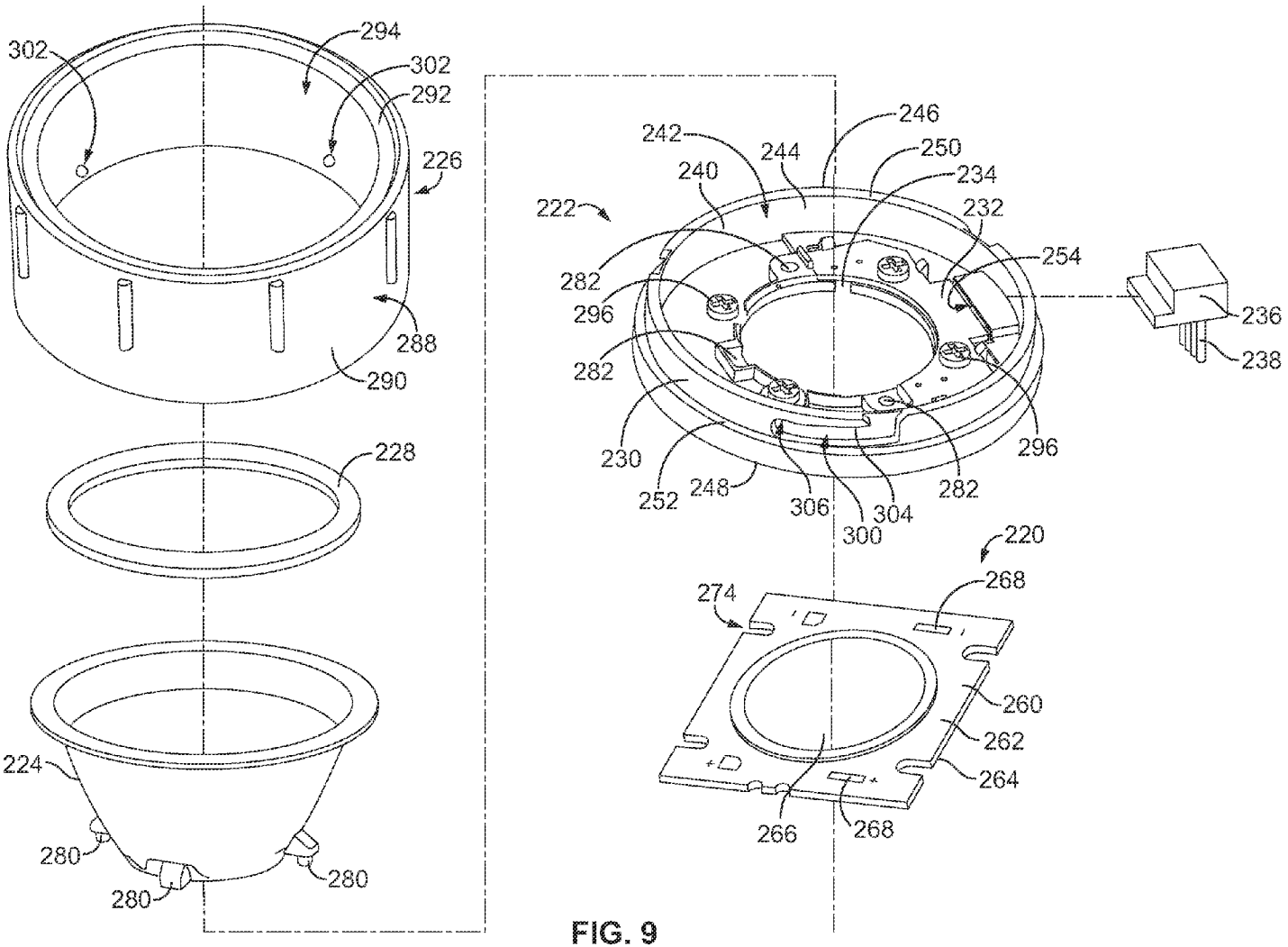
FIG. 9 is an exploded view of the light module shown in FIG. 8.

FIG. 9 is an exploded view of the light module 210. The light module 210 includes a light engine 220, a base ring assembly 222, an optical component 224, and a top cover assembly 226. A compression ring 228 is configured to be held between the top cover assembly 226 and the optical component 224. A thermal pad may optionally coupled to the light engine 220 to dissipate heat from the light engine 220.

The base ring assembly 222 includes a base ring 230 and a contact holder 232. The contact holder 232 holds power contacts 234 that are configured to be electrically connected to the light engine 220. A power connector 236 is configured to be coupled to the contact holder 232 to provide power to the light engine 220. The power connector 236 is terminated to an end of a power cable 238. In an exemplary embodiment, the power connector 236 is configured to be couple to the contact holder 232 at a separable interface. For example, the power connector 236 may be plugged into the base ring 230 and unplugged from the base ring 230 to mate and unmate from the contact holder 232. A nonpermanent connection is made between the power connector 236 and the contact holder 232 at a power connector interface of the contact holder 232. For example, a solderless connection is provided between the power connector 236 and the power connector interface. In the illustrated embodiment, the contact holder 232 constitutes a circuit board having the power contacts 234 terminated thereto and pads (not shown) at the power connector interface.

The base ring 230 includes a side wall 240 defining a cavity 242. In the illustrated embodiment, the side wall 240 has a cylindrical shape defined by an inner surface 244 and an outer surface 246. The side wall 240 extends between a bottom edge 248 and a top edge 250 opposite the bottom edge 248. In exemplary embodiment, the side wall 240 has a rim 252 proximate to the bottom edge 248. The rim 252 extends outward from the outer surface 246. The side wall 240 includes an opening 254 therethrough that is configured to receive the power connector 236. The opening 254 provides access to the contact holder 232 such that the power connector 236 may be coupled to the contact holder 232.

The light engine 220 includes a printed circuit board (PCB) 260 having a first surface 262 and a second surface 264. The PCB 260 includes a plurality of openings 274 extending therethrough between the first and second surfaces 262, 264. A thermal pad may be coupled to the second surface 264 to dissipate heat from the PCB 260. Optionally, the thermal pad may be coupled to the second surface 264 using a thermally conductive epoxy or thermally conductive adhesive. Other securing means may be used to secure the thermal pad to the second surface 264 in alternative embodiments.

An LED 266 is coupled to the first surface 262 of the PCB 260. The LED 266 emits light therefrom. Any number of LEDs may be provided in alternative embodiments. The LED 266 is electrically connected to circuitry within the PCB 260 and power is fed to the LED 266 by the PCB 260. The PCB 260 has a plurality of power terminals 268. In an exemplary embodiment, the power terminals 268 constitute pads provided on the first surface 62. The power terminals 268 are configured to be engaged by corresponding power contacts 234. Power is transferred from the power contacts 234 to the power terminals 268.

In an exemplary embodiment, the light module 210 may include a set of light engines 220 including at least two different types of light engines 220. The different types of light engines 220 differ from one another by having different lighting characteristics. For example, the different types of light engines 220 may have a different number of LEDs 266 or a different arrangement of LEDs 266 on the surface of the PCB 260. The different types of light engines 220 may have different types of LEDs 266, such as LEDs 266 that generate different colors or intensities of light. The light module 210 is configurable by selecting from the set of light engines 220 to achieve a desired light distribution.

The optical component 224 constitutes a reflector. The optical component 224 may be a different type of component in an alternative embodiment, such as a lens. In the illustrated embodiment, the reflector is manufactured from a metalized plastic body. Alternatively, the reflector may be manufactured from a metal material. The optical component 224 emits the light generated by the LED 266. The optical component 224 is configured to be received in the cavity 242. The optical component 224 includes mounting features 280 that interact with corresponding mounting features 282 of the base ring 230 to secure the optical component 224 with respect to the base ring 230. Alternatively, another component, such as an optical holder may be coupled to the base ring 230 or the top cover assembly 226 to hold the optical component 224 with respect to the LED 266. Optionally, the optical holder may be movably coupled to the base ring 230 or the top cover assembly 226 to change a relative position of the optical component 224 with respect to the LED 266, such as to change a lighting effect of the light module 210. In an exemplary embodiment, the light module 210 may include a set of optical components 224 including at least two different types of optical components 224. The different types of optical components 224 differ from one another by having different lighting characteristics. For example, the different types of optical components 224 may have different lighting patterns and/or different lighting characteristics.

The compression ring 228 is configured to be positioned between the top cover assembly 226 and the optical component 224. The compression ring 228 may be placed over the top of the optical component 224 prior to coupling the top cover assembly 226 to the base ring assembly 222. The compression ring 228 is made from a compressible material, such as foam material, a silicone rubber material, or another type of compressible material. In an alternative embodiment, the compression ring 228 may be manufactured from a metal material formed as a spring, such as a wave spring washer, that may be placed between the top cover assembly 226 and the optical component 224. The compression ring 228 takes up tolerances between the optical component 224 and the top cover assembly 226 when the top cover assembly 226 is coupled to the base ring 230.

The top cover assembly 226 includes a collar 288 having side wall 290 and a top wall 292. The top wall 292 has an opening 294 therethrough. The opening 294 is aligned above the optical component 224 and allows light emitted by the optical component 224 to be emitted from the light module 210. The collar 288 is configured to be coupled to the base ring 230 during assembly of the light module 210. In an exemplary embodiment, the collar 288 is rotatably coupled to the base ring 230, however the top cover may be coupled to the base ring 230 in a different manner using different securing means in alternative embodiments. During assembly, the collar 288 is loaded onto the base ring 230 and rotated to a locked position. The collar 288 holds the optical component 224 in the cavity 242. The compression ring 228 is received between the collar 288 and optical component 224 to take up any tolerance between the collar 288 and the optical component 224.

In an exemplary embodiment, the base ring 230 and the collar 288 include securing features 300, 302, respectively. The securing features 300, 302 engage one another when the collar 288 is coupled to the base ring 230. The engagement between the securing features 300, 302 secures the collar 288 to the base ring 230. In an exemplary embodiment, the securing features 300, 302 allow mating and unmating of the collar 288 with respect to the base ring 230. As such, the collar 288 may be removed from the base ring 230 to access the other components, such as the optical component 224. As such, the optical component 224 maybe removed and replaced with a different type of optical component 224.

In the illustrated embodiment, the securing features 300, 302 define a bayonet-type connection. The securing feature 300 constitutes a recessed track formed in the side wall 240. The securing feature 302 constitutes a protrusion extending inward from the side wall 290 that is configured to be received in the recessed track to secure the collar 288 to the base ring 230. Alternatively, the securing feature 300 may constitute a protrusion extending out from the side wall 240 and the securing feature 302 may constitute a recessed track in the inner surface of the side wall 290. Other types of securing features 300, 302 may be used in alternative embodiments. For example, the securing features 300, 302 may constitute threads on the side walls 240, 290 that allow threaded coupling between the collar 288 and the base ring 230. Other examples of securing features 300, 302 include latches, pins, fasteners, and the like that are used to secure the collar 288 with respect to the base ring 230. In an exemplary embodiment, the securing feature 300 includes a cam surface 304 and a locking notch 306 at an end of the cam surface 304. During assembly, the collar 288 is rotated in a mating direction along the cam surface 304 until the securing feature 302 is received in the locking notch 306.

Figure 10:
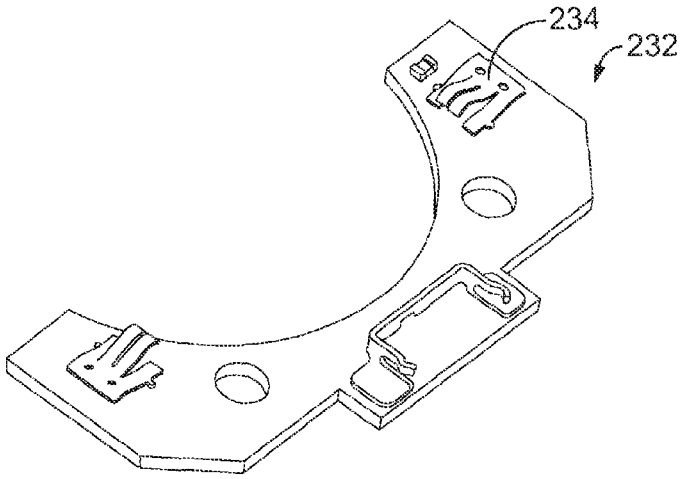
FIG. 10 is a bottom perspective view of an exemplary embodiment of a contact holder for the light module shown in FIG. 8.

FIG. 10 is a bottom perspective view of the contact holder 232. The power contacts 234 are provided on the bottom surface of the circuit board of the contact holder 232. An electrical component, such as a temperature sensor, is mounted to the circuit board. Other types of electrical components may be mounted to the circuit board, such as a microprocessor, to control the power scheme for the light module 210. A temperature sensor may be coupled to the circuit board of the contact holder 232.

Figure 11:
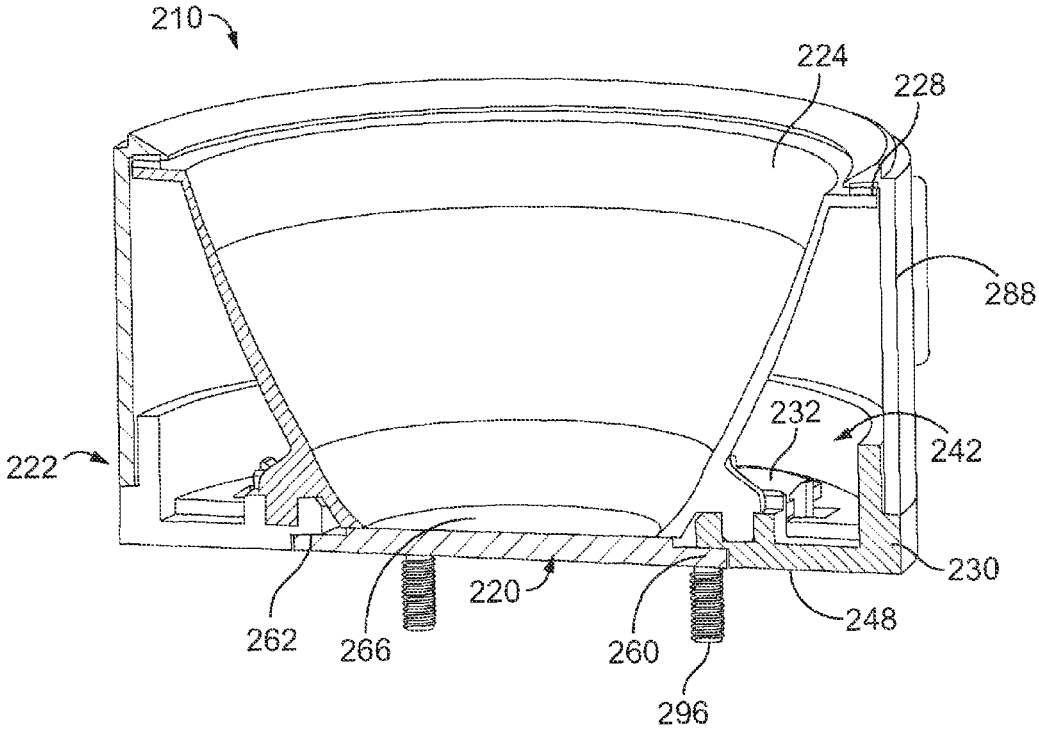
FIG. 11 is a partial sectional view of the light module shown in FIG. 8.

FIG. 11 is a partial sectional view of the light module 210. During assembly, the light engine 220 is coupled to the base ring 230 by loading the PCB 260 through the bottom edge 248 of the base ring 230. The first surface 262 faces upward such that the LED 266 is exposed within the cavity 242. Fasteners 296 secure the contact holder 232 to the base ring 230. The fasteners 296 are used to secure the base ring assembly 222 to another structure, such as a heat sink or another structure within the fixture 212 (shown in FIG. 8). The optical component 224 is then mounted to the base ring 230 above the LED 266. The compression ring 228 is loaded onto the optical component 224 and then the collar 288 is mounted to the base ring 230.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A light module comprising:

a base ring configured to hold a light engine having a printed circuit board having a light emitting diode (LED), the base ring having side walls defining a cavity, the side walls having a securing feature;

an optical component received in the cavity, the optical component being positioned to receive light from the LED, the optical component having a predetermined lighting characteristic, the optical component being configured to emit the light generated by the LEDs in accordance with the predetermined lighting characteristic;

a top cover coupled to the base ring, the top cover having a securing feature engaging the securing feature of the base ring to couple the top cover to the base ring, the top cover being rotatably coupled to the base ring such that the securing feature of the top cover is rotated along the securing feature of the base ring as the top cover is coupled to the base ring; and a compression ring positioned between the top cover and the optical component, the compression ring being compressed between the top cover and the optical component when the top cover is coupled to the base ring.

2. The light module of claim 1, wherein the compression ring is compressed as the top cover is rotatably coupled to the base ring.

3. The light module of claim 1, wherein the base ring and the top cover have a circular geometry, the securing feature of the top cover being coupled to the securing feature of the base ring by a twisting action of the top cover with respect to the base ring.

4. The light module of claim 1, wherein the side walls have a top edge, the top cover has a top surface, at least one of the securing features includes a cam surface, wherein the top surface is drawn toward the top edge when the securing feature is rotated along the cam surface, the compression ring being compressed as the top surface is drawn toward the top edge.

5. The light module of claim 1, wherein the securing feature of either the base ring or the top cover comprises a recessed track, the securing feature of the other of the base ring or the top cover comprises a protrusion received in the recess track, the recessed track having a cam surface and a locking notch at an end of the cam surface.

6. The light module of claim 1, wherein the base ring has fastener mounts receiving fasteners therein, the fasteners being configured to secure the base ring to another structure, the fastener mounts having latches that hold the fasteners in the fastener mounts.

7. The light module of claim 1, wherein the printed circuit board includes openings therethrough, the base ring having lugs extending therefrom, the lugs being configured to be loaded into the openings and engage the printed circuit board in an interference fit to hold the printed circuit board relative to the base ring.

8. The light module of claim 1, wherein the base ring includes keys extending into the cavity, the printed circuit board engages the keys to orient the printed circuit board with respect to the base ring, the optical component engaging the keys to orient the optical component with respect to the base ring.

9. The light module of claim 1, wherein the optical component is removable from the cavity without removing the light engine from the base ring.

10. The light module of claim 1, wherein the optical component includes an outer surface, the side walls having a top edge, the outer surface being flush with the top edge, the compression ring spanning across the interface between the outer surface and the top edge.

11. The light module of claim 1, further comprising a power connector configured to be coupled to the light engine at a separable power connector interface, the power connector being substantially flush with the base ring when coupled to the power connector interface.

12. A light module comprising:

a power connector;

a light engine having a printed circuit board and a light emitting diode (LED) coupled to the printed circuit board, the printed circuit board having a power connector interface defining a separable interface for coupling with the power connector;

a base ring holding the light engine, the base ring having side walls defining a cavity, the side walls having a securing feature;

an optical component received in the cavity, the optical component being positioned to receive light from the LED, the optical component having a predetermined lighting characteristic, the optical component being configured to emit the light generated by the LED in accordance with the predetermined lighting characteristic;

a top cover coupled to the base ring, the top cover having a securing feature engaging the securing feature of the base ring to couple the top cover to the base ring; and a compression ring positioned between the top cover and the optical component, the compression ring being compressed between the top cover and the optical component when the top cover is coupled to the base ring.

13. The light module of claim 12, wherein the base ring and the top cover have a circular geometry, the securing feature of the top cover being coupled to the securing feature of the base ring by a twisting action of the top cover with respect to the base ring.

14. The light module of claim 12, wherein the side walls have a top edge, the top cover has a top surface, at least one of the securing features includes a cam surface, wherein the top surface is drawn toward the top edge when the securing feature is rotated along the cam surface, the compression ring being compressed as the top surface is drawn toward the top edge.

15. The light module of claim 12, wherein the securing feature of either the base ring or the top cover comprises a recessed track, the securing feature of the other of the base ring or the top cover comprises a protrusion received in the recess track, the recessed track having a cam surface and a locking notch at an end of the cam surface.

16. The light module of claim 12, wherein the base ring has fastener mounts receiving fasteners therein, the fasteners being configured to secure the base ring to another structure, the fastener mounts having latches that hold the fasteners in the fastener mounts.

17. The light module of claim 12, wherein the optical component is removable from the cavity without removing the light engine from the base ring.

18. A light module comprising:

a base ring having side walls defining a cavity, the side walls having a securing feature;

a set of light engines comprising at least two different types of printed circuit boards (PCBs), the different types of PCBs having different light emitting diodes (LEDs) coupled thereto, a select one of the PCBs being positioned within the cavity;

a set of optical components comprising at least two different types of optical components, the different types of optical components differ from one another by having different lighting patterns, a select one of the optical components being received in the cavity adjacent to the selected PCB and receiving light from the corresponding LED, the selected optical component being configured to emit the light generated by the LED in accordance with a predetermined lighting characteristic;

a top cover coupled to the base ring, the top cover having a securing feature engaging the securing feature of the base ring to couple the top cover to the base ring; and a compression ring positioned between the top cover and the optical component, the compression ring being compressed between the top cover and the optical component when the top cover is coupled to the base ring.

19. The light module of claim 18, wherein the different types of PCBs differ from one another by having the LEDs in different positions on a surface of the PCBs and/or by having different colored LEDs on the PCBs.

20. The light module of claim 18, wherein the different types of optical components differ from one another by having different angles of illumination.

* * * * *